US005713469A

United States Patent [19]

Buscema

[11] Patent Number: 5,713,469

[45] Date of Patent: Feb. 3, 1998

[54] CARTON WITH INTEGRAL CORE

[75] Inventor: Craig W. Buscema, Atlanta, Ga.

[73] Assignee: The Mead Corporation, Dayton, Ohio

[21] Appl. No.: 684,613

[22] Filed: Jul. 19, 1996

[51] Int. Cl.[6] ..... B65D 85/04; B65H 75/00

[52] U.S. Cl. ..... 206/396; 206/397; 242/171

[58] Field of Search ..... 206/389, 395–397, 206/408, 409; 242/163, 171

[56] References Cited

U.S. PATENT DOCUMENTS

| | | | |
|---|---|---|---|
| 1,889,933 | 12/1932 | Pratt | 206/396 |
| 1,996,965 | 4/1935 | Keppler | 220/468 |
| 2,737,292 | 3/1956 | Neff | 206/303 |
| 2,824,641 | 2/1958 | Koenig | 206/396 |
| 2,890,821 | 6/1959 | Becker | 206/396 |
| 2,967,655 | 1/1961 | Seger, Jr. | 229/109 |
| 3,115,376 | 12/1963 | Cupo | 312/35 |
| 3,446,419 | 5/1969 | Mueller | 206/303 |
| 4,511,037 | 4/1985 | Lucous | 206/396 |
| 4,813,539 | 3/1989 | Church et al. | 206/396 |
| 4,817,796 | 4/1989 | Camillio et al. | 206/396 |
| 5,449,070 | 9/1995 | Broderick | 206/396 |
| 5,533,620 | 7/1996 | Torterolo | 206/396 |

*Primary Examiner*—Jimmy G. Foster
*Attorney, Agent, or Firm*—Michael V. Drew

[57] ABSTRACT

A carton (10) has a plurality of adjoining side walls (20, 21, 22, 23, 24, 25, 26, 27, 28) which form a tubular structure. A plurality of core panels (41, 42, 44) adjoin one another to form a core member (40) which is centrally and substantially perpendicularly adjoined to an end closure.

18 Claims, 3 Drawing Sheets

CARTON WITH INTEGRAL CORE

TECHNICAL FIELD OF THE INVENTION

The invention relates to cartons containing hubs or hub-like implements for wound stranded materials such as wire or rope, and more particular to cartons having a hub-like structure integrally formed with the carton.

BACKGROUND OF THE INVENTION

Cartons having hub or hub-like implements are useful for packaging and dispensing materials that are either stored on a spool or stored in a spooled configuration. For example, wire, rope, yarn and similar stranded material. It would be desirable economically and for convenience to have a carton which has a hub integrally formed with the carton. It would be further desirable to have such a carton which could be erected from a unitary blank.

SUMMARY OF THE INVENTION

According to a preferred embodiment of the invention, a carton has a plurality of adjoining side walls which form a tubular structure. A plurality of core panels are adjoined to one another in angular relationship to form a hollow core member. The core member is centrally and perpendicularly adjoined to one of the end closures (top or bottom).

In a blank for forming the carton the end closures are formed by multiple plies of the carton. The plurality of core panels are adjoined to one of the end closure plies.

Other features and advantages of the present invention will be apparent from the following description, the accompanying drawings, and the appended claims.

DETAILED DESCRIPTION OF THE PREFERRED EMBODIMENT

Figure 1:
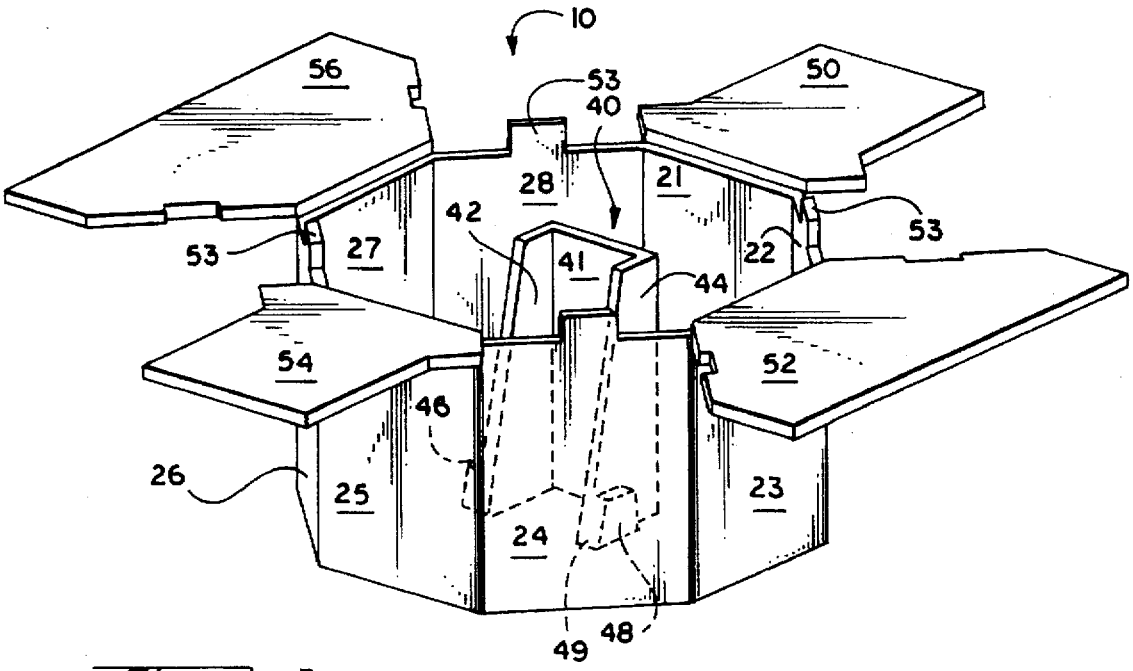
FIG. 1 is an isometric illustration of a carton with integral core according to a preferred embodiment of the invention.
Figure 3:
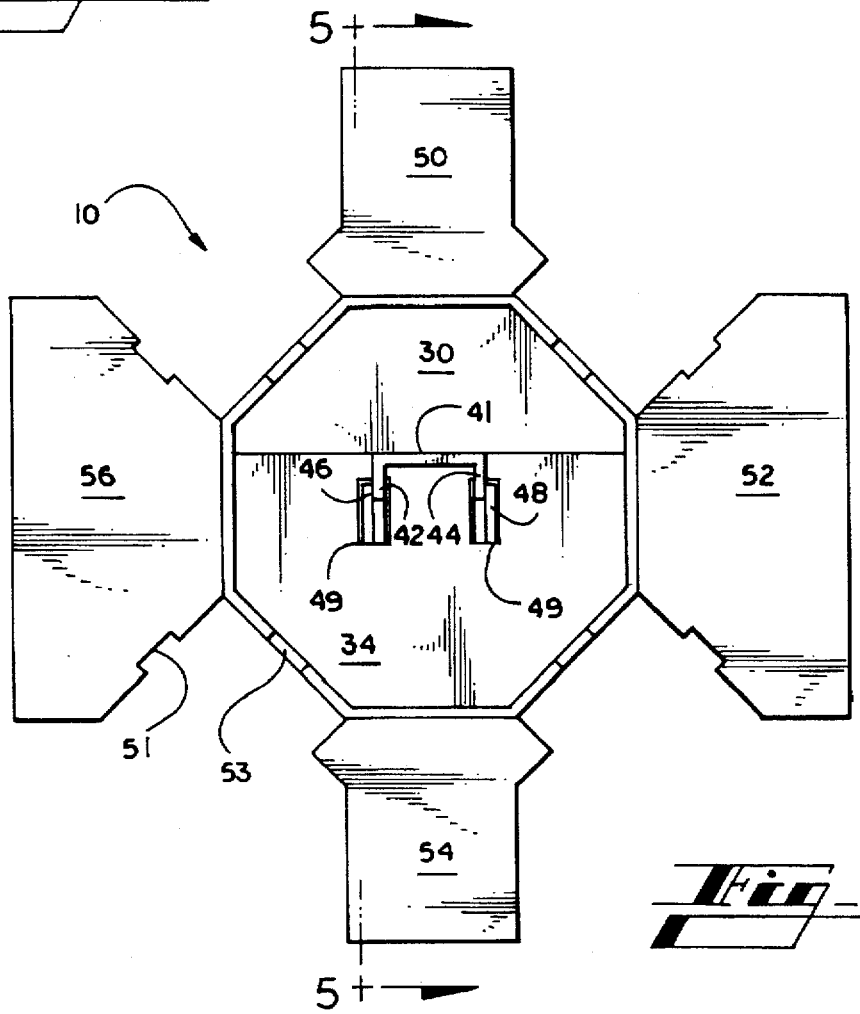
FIG. 3 is a top plan illustration of the carton of FIG. 1 looking downward into the carton viewing the bottom end closure and the erected core member.
Figure 2:
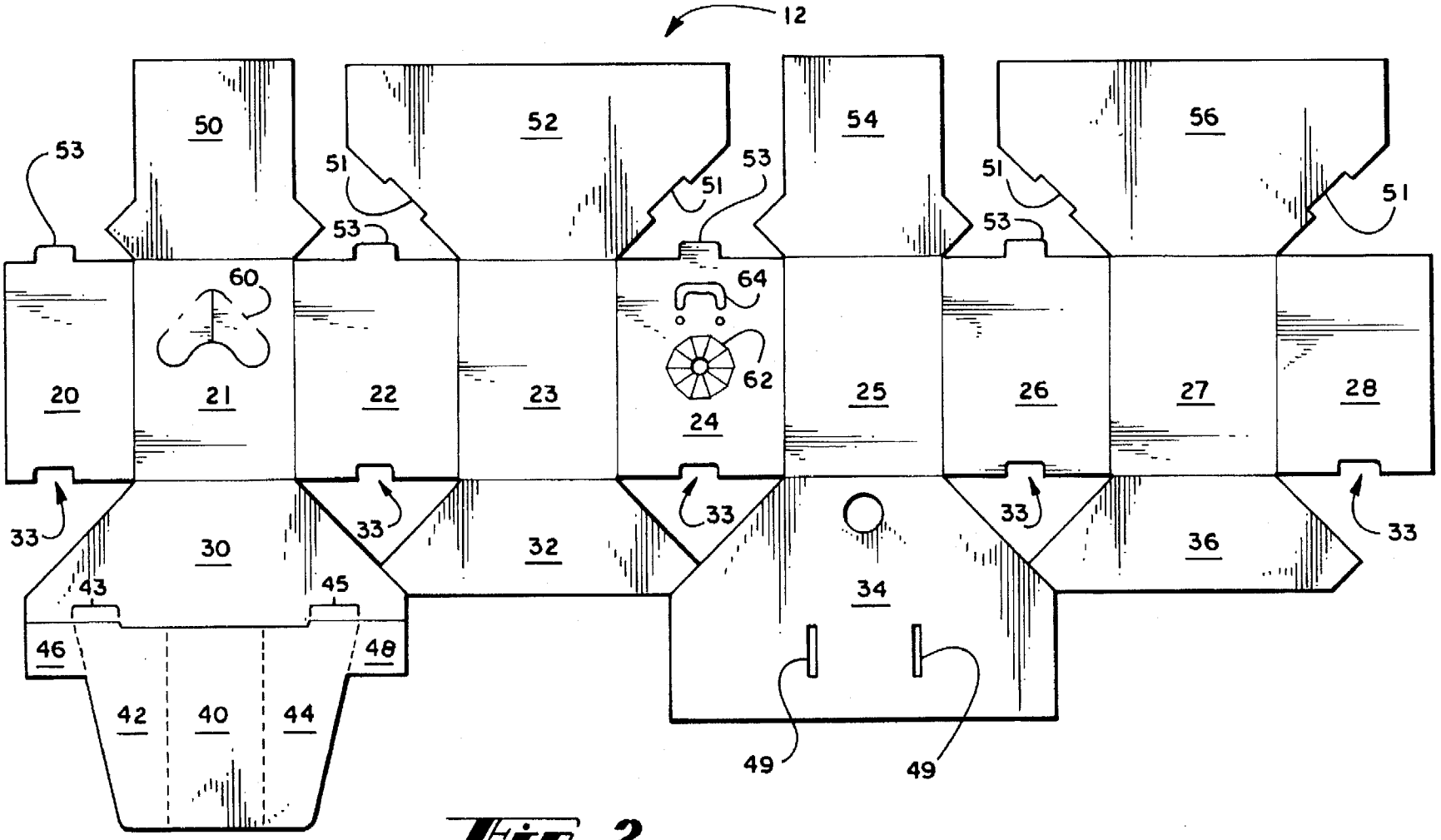
FIG. 2 is a plan illustration of a blank for forming the carton illustrated in FIG. 1.
Figure 6:
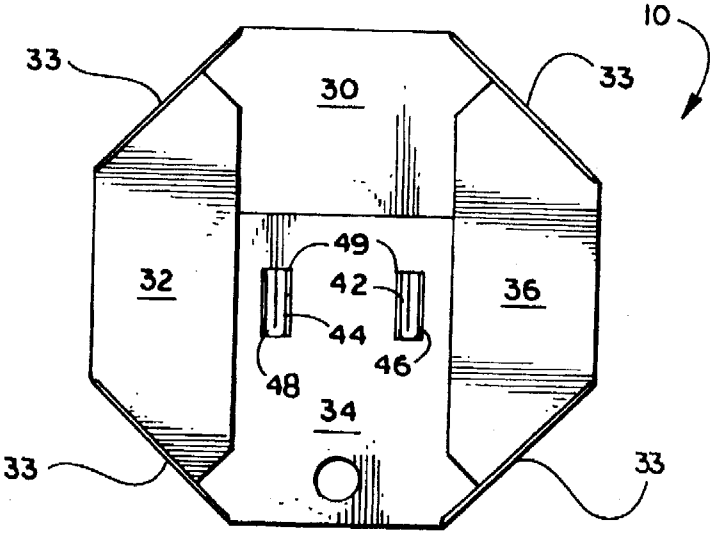
FIG. 6 is a plan illustration of the underside of the bottom wall of the carton of FIG. 1 showing the stabilizing tabs and flaps of the core member in engagement with the bottom end closure of the carton.
Figure 5:
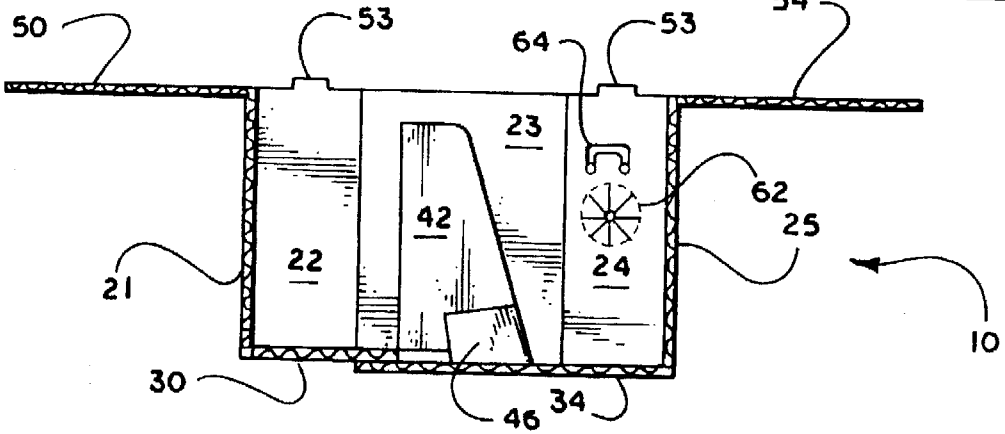
FIG. 5 is a side sectional elevational view of the carton of FIG. 1 taken along line 5—5 of FIG. 3.
Figure 4:
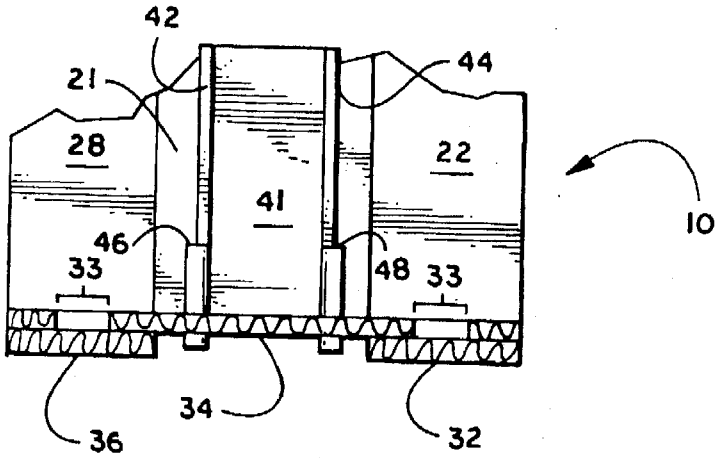
FIG. 4 is a sectional illustration of the carton of FIG. 1 showing the erected core member.

Throughout the figures the same reference numerals are used to refer to identical features of the preferred embodiment illustrated. Referring first to FIG. 1, therein is shown a carton with an integral core 10 according to a preferred embodiment of the invention. Referring now also to FIG. 2, therein is illustrated a blank 12 for forming the carton of FIG. 1.

The preferred embodiment of carton 10 which is illustrated is eight-sided to enhance its stacking strength and overall structural integrity. However, the invention is suitable for use with carton configurations of several different multiples of sides. In general, the carton 10 of the invention has a tubular body and a bottom end closure, or top and bottom end closure. In the preferred embodiment illustrated, the tubular structure of the carton is formed by panels 20, 21, 22, 23, 24, 25, 26, 27 and 28. Bottom end closure is provided by panels 30, 32, 34 and 36. Similarly, top end closure is provided by panels 50, 52, 54 and 56. To facilitate stacking, stacking tabs 53 extend from the upper edge of several of the tube-forming side wall panels 20, 22, 24 and 26. The tabs 53 have complementary stacking notches 33 formed in the bottom edge of tube-forming side wall panels 20, 22, 24 and 26, and in one of the side wall panels 28 which overlaps another to close the tube. Several of the top enclosure panels 52, 56 also have notches 51 for accommodating the stacking tabs.

Still referring to FIGS. 1 and 2, a core member 40 is formed from a central core panel 41 which is joined at its sides by flanking core panels 42, 44. The core member 40 is joined to the bottom end closure such that it is centrally disposed in an upright posture (that is, substantially perpendicular with respect to the bottom closure and substantially parallel with respect to the tubular side walls) within the tubular side walls. In the blank 12 of the preferred embodiment, the central core panel 41 is foldably joined to one of the bottom closure panels 30. The erected core member 40 is stabilized by either or both of a pair of opposing stabilizing tabs 43, 45 and 46, 48. A set of stabilizing tabs 43, 45 is integrally formed at the lower end of respective flanking core panels 42, 44. Pivotable stabilizing flaps 46, 48 are foldably joined along respective distal ends of the flanking core panels 42, 44. The stabilizing tabs 43, 45 and flaps 46, 48 are engaged with the bottom end closure to help immobilize the core member 40. The stabilizing tabs 43, 45 and flaps 46, 48 are engaged with the bottom closure by means of stabilizing slots 49 which receive the integral stabilizing tabs 43, 45 and the pivotable stabilizing flaps 46, 48 which have been folded into face-to-face relationship with respective flanking panels 42, 44.

What is claimed is:

1. A carton comprising:

a plurality of adjoining side wall panels forming a tubular structure;

an end closure;

a plurality of core panels foldably adjoining one another at angles thereto forming a core member adjoining said end closure, said core member disposed in substantially perpendicular relationship with respect to said end closure, at least one of said core panels having a stabilizing tab depending therefrom interconnecting said at least one of said core panels and said end closure such that said core member is maintained in said substantially perpendicular relationship with respect to said end closure.

2. The carton of claim 1, said end closure comprising a plurality of end closure panels and wherein at least one of said plurality of core panels foldably adjoins one of said end closure panels and wherein said stabilizing tab is interconnected with said plurality of end closure panels.

3. The carton of claim 2, wherein said stabilizing tab is interconnected with a respective one of said plurality of said end closure panels by means of an aperture therein corresponding to and adapted for receiving said stabilizing tab in locking engagement therewith.

4. The carton of claim 3, further comprising a stabilizing flap foldably adjoining respective distal transverse edges of said plurality of core panels in cooperative engagement with said aperture.

5. The carton of claim 2, further comprising a stabilizing flap foldably adjoining respective distal transverse edges of said plurality of core panels in cooperative engagement with a respective one of said plurality of end closure panels such that said core member is further maintained in said substantially perpendicular relationship with respect to said plurality of end closure panels.

6. The carton of claim 1, further comprising a stabilizing flap foldably adjoining respective distal transverse edges of said plurality of core panels in cooperative engagement with said end closure such that said core member is further maintained in said substantially perpendicular relationship with respect to said end closure.

7. The carton of claim 1, further comprising a second end closure opposing said end closure.

8. A carton formed from a blank, the carton comprising:

a plurality of adjoining side wall panels forming a tubular structure;

an end closure;

a plurality of core panels adjoining one another at angles thereto including a central core panel adjoining said end closure and further including a plurality of flanking core panels transversely disposed with respect to said central core panel, said core panels forming a core member disposed in substantially perpendicular relationship with respect to said end closure, distal ends of said transverse core panels respectively having a stabilizing tab depending therefrom in cooperative engagement with said end closure such that said core member is maintained in said substantially perpendicular relationship with respect to said end closure.

9. The carton of claim 8, said end closure comprising a plurality of end closure panels and wherein said at least one of said plurality of core panels foldably adjoins one of said end closure panels and wherein said stabilizing tab is in cooperative engagement with said plurality of end closure panels.

10. The carton of claim 9, wherein said stabilizing tab is in cooperative engagement with a respective one of said plurality of said end closure panels by means of an aperture therein corresponding to and adapted for receiving said stabilizing tab in locking engagement therewith.

11. The carton of claim 10, further comprising a stabilizing flap foldably adjoining respective distal transverse edges of said plurality of core panels in cooperative engagement with said aperture.

12. The carton of claim 9, further comprising a stabilizing flap foldably adjoining respective distal transverse edges of said plurality of core panels in cooperative engagement with a respective one of said plurality of end closure panels such that said core member is further maintained in said substantially perpendicular relationship with respect to said plurality of end closure panels.

13. The carton of claim 8, further comprising a stabilizing flap foldably adjoining respective distal transverse edges of said plurality of core panels in 30 cooperative engagement with said end closure such that said core member is further maintained in said substantially perpendicular relationship with respect to said end closure.

14. The carton of claim 1, further comprising a second end closure opposing said end closure.

15. A blank for forming a carton, the blank comprising:

a plurality of foldably adjoining side wall panels for forming a tubular structure;

a plurality of end flaps foldably adjoining said plurality of foldably adjoining side wall panels along a first end thereof;

a plurality of core panels foldably attached to one another at least one of which is foldably attached to one of said plurality of end flaps; and a plurality of stabilizing tabs respectively depending from said plurality of core panels;

wherein said plurality of foldably adjoining side wall panels may be joined to form a tubular structure, said plurality of end flaps may be folded with respect to said side wall panels and affixed to one another to form an end closure and said core panels may be folded with respect to one another and with respect to said one of said plurality of end flaps to form a core member substantially parallely disposed with respect to said tubular structure, and said stabilizing tabs may be engaged with apertures formed in said plurality of end flaps.

16. The blank of claim 15, wherein said plurality of core panels comprise a central core panel foldably adjoining said one of said plurality of end flaps having flanking core panels foldably adjoining said central core panel along respective transverse edges thereof and wherein said plurality of stabilizing tabs comprise at least one stabilizing tab depending from each distal end of said flanking core panels.

17. The blank of claim 16, further comprising a stabilizing flap foldably adjoined along each distal transverse edge of said plurality of core panels such that said stabilizing flap may be folded into face-to-face relationship with respect to respective core panels and engaged with said apertures formed in said plurality of end flaps.

18. The blank of claim 15, further comprising a stabilizing flap foldably adjoined along each distal transverse edge of said plurality of core panels such that said stabilizing flap may be folded into face-to-face relationship with respect to respective core panels and engaged with said apertures formed in said plurality of end flaps.

* * * * *